United States Patent [19]

King

[11] Patent Number: 4,619,169

[45] Date of Patent: Oct. 28, 1986

[54] CUTTER MECHANISM FOR LAMINATE SLITTING MACHINE

[75] Inventor: Michael T. King, Palatine, Ill.

[73] Assignee: D&K Custom Machine Design, Inc., Elk Grove Village, Ill.

[21] Appl. No.: 782,961

[22] Filed: Oct. 2, 1985

[51] Int. Cl.[4] ..... B26D 5/22

[52] U.S. Cl. ..... 83/697; 83/578; 83/614; 83/635

[58] Field of Search ..... 83/697, 614, 578, 635

[56] References Cited

U.S. PATENT DOCUMENTS 4,329,896 5/1982 Singer ..... 83/614 X

*Primary Examiner*—James M. Meister

*Attorney, Agent, or Firm*—Robert E. Wagner; Ralph R. Rath

[57] ABSTRACT

The cutter mechanism for slitting laminate material interconnecting overlapping borders of adjacent articles includes an elongated body that has a pair of upwardly-extending guide feet on opposite ends along one edge of the body and downwardly-extending guide feet on opposite ends adjacent the other edge with a generally rectangular slot between the respective feet and extending from opposite ends. The slots have bases which extend perpendicular to the opposite edges and thus perpendicular to the path of movement of the cutter means to provide sharp cutting edges between the respective feet.

4 Claims, 5 Drawing Figures

CUTTER MECHANISM FOR LAMINATE SLITTING MACHINE

DESCRIPTION

1. Technical Field

The present invention relates generally to laminated sheet trimmers and, more specifically, to a trimming machine having a double-edged blade operable to separate two overlapping sheets of laminated material by slitting the laminate between the sheets.

2. Background Prior Art

The use of laminating machines to apply laminate material to such items as menus, placemats and the like for their protection and increased durability has been a common practice for many years. In certain prior art laminating machines, items or articles to be laminated are fed at spaced intervals between an upper and lower web of laminate material which engage the top and bottom of the work to be laminated. Heat is then applied to adhere the laminate to both surfaces of the article.

Other types of laminating machines utilize a single web of laminate material for application to one surface of an article. In such machines, the borders or margins of adjacent or successive articles are overlapped, forming a continuous web of laminated articles, which avoids spillage of the laminate material in between the articles. Such spillage could cause jamming of the laminating machine and other operational difficulties.

One method of separating successive laminated articles in a continuous web involves the use of a slitting machine in which operators manually separate the overlapped portion between adjacent articles. A knife blade is used to slit the laminate material between the overlapped borders of successive articles in the web. It can be appreciated that the speed of such manually-operated cutter is dependent on the individual skill and experience of the operator, and involves considerable labor costs.

A second type of manually-operated slitter may be used to separate adjacent articles in a web, wherein a guillotine-type blade cuts the ends of adjacent articles to form a border. Although such cutters may be somewhat easier to operate than those described above which slits adjacent articles apart, it has been found that guillotine-blade cutters are inefficient since at least two separate cuts must be made to assure that both adjacent articles are properly trimmed. One cut is needed to form a margin or border of a desired size on one article and a second cut is made on the other article to trim away the overlapped portion of the border from the first article.

A further method of separating successive laminating sheets is to produce a small slit along one edge of the film in the overlap area and then stretch the sheet along that edge resulting in a tearing of the laminate film from the slit. However, because new films, such as linear polyethylene, have the characteristic of being more resistent to tearing, this procedure has severe limitations.

More recently, a fully automated system has been developed which utilizes a double-edged cutter that cuts or slits overlapped articles apart in an efficient and rapid operation. This system is disclosed in U.S. Pat. No. 4,329,896, which is incorporated herein by reference. While this system has received remarkable commercial acceptance in the industry, some problems have been encountered when certain laminating films are used. Thus, when certain thin laminating films are used, there is a tendency for some misalignment between the cutting edges of the blade and the overlapped portions which can result in jams or uneven cutting.

SUMMARY OF THE INVENTION

According to the present invention, a cutter means has been developed for slitting laminate material in interconnecting overlapping borders of adjacent articles which will accommodate some misalignment and which can be utilized for slitting all types of laminte material. The cutter means includes an elongated body having opposite edges and opposite ends with downwardly-extending guide feet or edges on opposite ends adjacent one edge and uwpardly-extending guide feet on opposite ends adjacent the other edge. The elongated body has generally rectangular slots extending from opposite ends between the respective feet and the slots have transversely-facing cutting blades located between the feet. The oppositely-facing cutting blades preferably have an elongated dimension of at least ½ inch to accommodate slight misalignment of the overlapping edges with respect to the cutter blades. It has been found that the improved cutter element is capable of cutting virtually any type of laminate material that might be utilized for the laminating operation.

BRIEF DESCRIPTION OF SEVERAL VIEWS OF DRAWINGS

DETAILED DESCRIPTION

Figure 1:
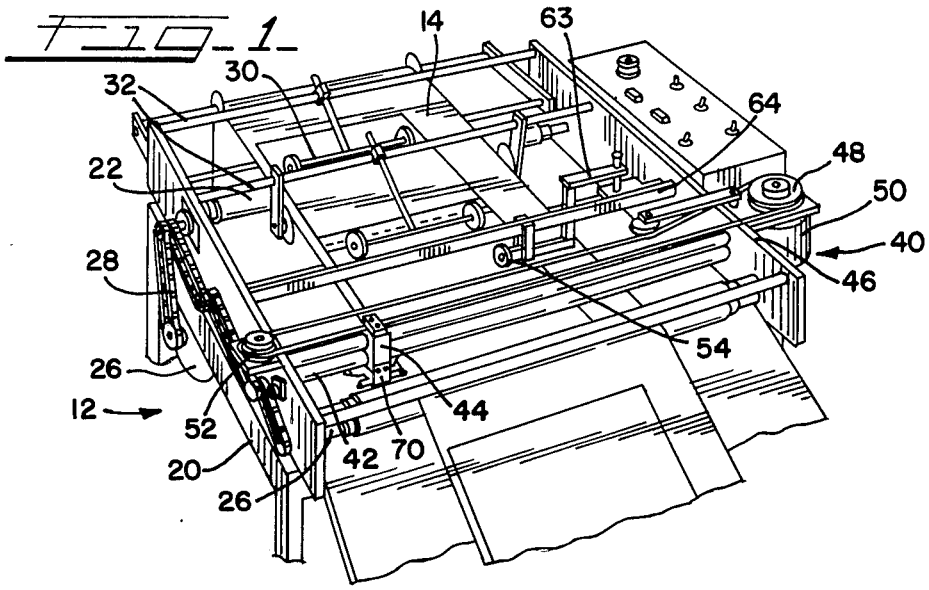
FIG. 1 is a perspective view of a laminating machine having the present invention incorporated therein.
Figure 2:
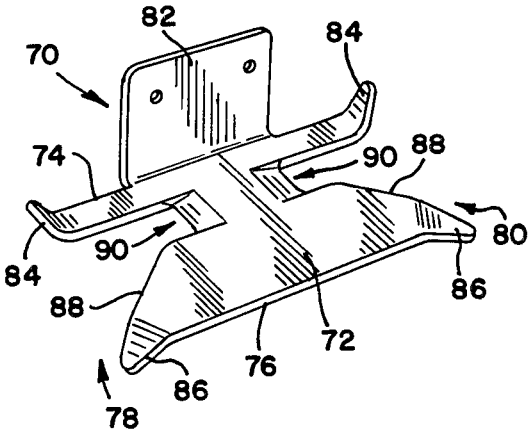
FIG. 2 is a perspective view of the cutter mechanism used in the laminate machine of FIG. 1.
Figure 3:
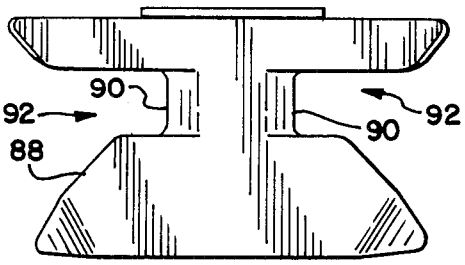
FIG. 3 is a top plan view of the cutter mechanism.
Figure 4:
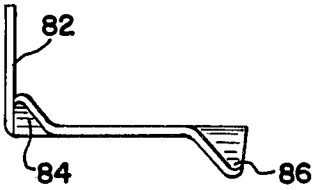
FIG. 4 is an end view of the cutter mechanism.
Figure 5:
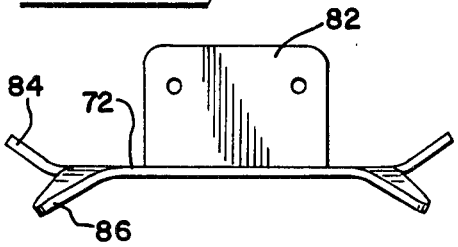
FIG. 5 is a side elevational view of the cutter mechanism.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Referring now to the drawings, particularly FIG. 1, the slitter having the present invention incorporated therein is generally designated by reference numeral 12. A web of laminated articles 14 is fed to the machine from a source (not shown) in the direction generally indicated by the arrow in FIG. 1. The slitter 12 includes a generally rectangular frame 20 which supports front and rear drive rollers 22 and 24 which are driven by a motor 26 through drive chains 28. Hold-down rollers 20 are poisitioned along frame 20 and are mounted on shafts 32. The hold-down rollers engage the web of laminated articles to assure positive movement therealong with a minimum of slippage.

The drive rollers 22 and 24 cooperating with the hold-down rollers move the sheet along a predetermined path to a cutting station, generally designated by reference numeral 40. A cutting station consists of guide bars 42 which support a cutter carriage 44 for reciprocation from side to side across the frame 20. The cutter carriage 44 is reciprocated through a cable 46 that is supported on one side of the frame on a drive sprocket 48 mounted on the output shaft of a motor 50 and an idler sprocket 52 at the opposite side of the frame.

The motor 50 is activated through a sensor roller 54 that is adjustably mounted on a roller bracket 56 which is fixed to a bar 68 attached to frame 20. The sensor 54 senses the overlapped portion of two articles and activates a brake (not shown) and the motor 50 in timed relation so that the overlapped borders are stopped in alignment with the cutter carriage, which supports a cutter blade 70 and the cutter carriage is moved across the articles. The system so far described is disclosed in U.S. Pat. No. 4,329,896.

According to the present invention, an improved cutter blade arrangement 70 has been developed which allows the slitting machine to operate more efficiently and under varying conditions. The cutter means 70 includes an elongated main body 72 that has opposite edges 74 and 76 and opposite ends 78 and 80. The elongated main body also has an integral extension 82 extending from an edge 74 for attachment to the cutter carriage 44.

The cutting blade assembly also has a pair of upwardly-facing guide edges or feet 84 located adjacent edge 74 and a pair of downwardly-facing guide edges 86 located adjacent the opposite edge 76. The elongated main body 72 also has inclined guide edges 88 leading from feet 86 to oppositely-facing cutting blades 90.

According to the present invention, the cutting blades 90 are located in generally rectangular slots 92 that are located in generally rectangular slots 92 that are located between the respective feet 84 and 86 on opposite ends of the elongated main body. The rectangular slots have sharpened linear bases which define the cutting blades and extend generally perpendicular to the opposite edges 74 and 76 or transversely of the main body 72. Thus, in actual use, the entire elongated cutting blades 90 extend perpendicular to the path of movement of the carriage 44.

While the length of the cutting edge may be varied, it has been found that a length of cutting edge in the range of about $\frac{1}{4}$ inch to about $\frac{3}{4}$ inch is desirable. In actual experimental use, this dimension is preferably about $\frac{1}{2}$ inch.

The resultant cutter means has superior characteristics over what was previously utilized by the Assignee of the present invention. In the prior cutting mechanism, the tapered edge was utilized to guide the overlapped edge towards the base of the tapered slot where the actual cutting operation was performed. With the improved thin laminating films that are presently being utilized, this tapered guide edge would have a tendency for the thin film to "bunch" prior to getting into the cutting edge, particularly when there is slight misalignment between the path of the cutting blade and the overlapped portio of the adjacent articles. With the present invention, a generally linear cutting edge that extends perpendicular to the path of movement of the carriage provides for a slight variation in the position of the overlapped edge while still performing a smooth clean cut of the material. Furthermore, with the cutting arrangement of the present invention, any type of laminating film can be severed, whether it be very thin, pliant film or the more heavier linear polyethylenes that have become very popular as laminates. The present invention provides more of a slicing or parting action rather than a shearing or chopping of the tapered blade of the prior art.

I claim:

1. In a slitting machine having cutter means for slitting laminate material between adjacent articles in a continuous web of said articles with said articles having overlapping borders, said cutting means having oppositely-facing cutting blades and being formed with a downwardly-extending guide edge on one side of each of said cutting blades and an upwardly-extending guide edge on the other side of each of the cutting blades, the improvement of said cutter means having generally rectangular slots between said downwardly-extending and upwardly-extending guide edges with said slots having generally transverse bases that define said cutting blades to accommodate slight misalignment between said cutter means and said overlapping borders.

2. A slitting machine as defined in claim 1, in which said transverse baes have a length of about one-half inch.

3. A cutter means for slitting laminate material interconnecting overlapping borders of adjacent articles, said cutter means including an elongated body having opposite edges and opposite ends, said body having downwardly-extending guide feet on opposite ends adjacent one edge and upwardly-extending guide feet on opposite ends adjacent the other edge with respective guide feet being generally transversely aligned, the improvement of said body having generally rectangular slots extending from said opposite ends between said feet and said slots having transversely-extending bases sharpened to define oppositely-facing cutting blades located between said feet.

4. In a slitting machine for slitting laminate material between adjacent articles in a continuous web of said articles with said articles having overlapping borders comprising cutting means movable back and forth across said web of articles for cutting said laminate material along said overlapping borders, the improvement of said cutting means including an elongated body having opposite edges and opposite ends, said elongated body having overlapping border-separating means on opposite ends adjacent respective edges and having generally rectangular slots extending from opposite ends between the respective separating means and having linear sharpened bases extending perpendicular to said edges and defining oppositely-facing cutting blades extending perpendicular to the path of movement of said cutting means to thus produce a parting action to the laminate material while the overlapping borders are held separated by said separating means.

* * * * *